US007896176B2

(12) United States Patent
McCormick

(10) Patent No.: US 7,896,176 B2
(45) Date of Patent: Mar. 1, 2011

(54) CONVERTIBLE BACK BAR

(75) Inventor: William R. McCormick, Pleasant Prairie, WI (US)

(73) Assignee: Brunswick Bowiling & Billard Corporation, Lake Forest, IL (US)

( * ) Notice: Subject to any disclaimer, the term of this patent is extended or adjusted under 35 U.S.C. 154(b) by 394 days.

(21) Appl. No.: 12/009,617

(22) Filed: Jan. 18, 2008

(65) Prior Publication Data

US 2009/0184075 A1 Jul. 23, 2009

(51) Int. Cl.
*A47F 5/08* (2006.01)

(52) U.S. Cl. ..... 211/87.01; 211/85.7; 211/68; 211/14; 211/85.29

(58) Field of Classification Search ..... 211/85.29, 211/87.01, 68, 14, 90.02, 90.04, 85.1, 85.7, 211/189, 134, 186, 183, 13.1; 108/50.01, 108/25, 50.15; 312/140.2–140.4, 224
See application file for complete search history.

(56) References Cited

U.S. PATENT DOCUMENTS

| | | | | | |
|---|---|---|---|---|---|
| 69,026 | A | * | 9/1867 | Richmond | 211/68 |
| 128,855 | A | * | 7/1872 | Collender | 473/1 |
| 297,031 | A | * | 4/1884 | Tea | 211/15 |
| 387,510 | A | * | 8/1888 | Graf | 211/68 |
| 391,677 | A | * | 10/1888 | Becker | 312/237 |
| 1,174,185 | A | * | 3/1916 | Scott | 211/68 |
| 3,869,106 | A | * | 3/1975 | Gregov | 248/345.1 |
| 4,272,136 | A | * | 6/1981 | Sengua | 312/196 |
| 4,609,975 | A | * | 9/1986 | Badolato et al. | 362/125 |
| 4,776,650 | A | * | 10/1988 | Ferenzi | 312/245 |
| 5,085,327 | A | * | 2/1992 | Mercer et al. | 211/85.7 |
| 5,172,814 | A | * | 12/1992 | Pell et al. | 211/85.2 |
| 5,267,786 | A | * | 12/1993 | Aisley | 312/224 |
| 5,413,228 | A | * | 5/1995 | Le Clerc | 211/13.1 |
| 5,931,317 | A | * | 8/1999 | Zusack et al. | 211/70.2 |
| 5,941,026 | A | * | 8/1999 | Eisenreich et al. | 52/36.5 |
| 5,947,583 | A | * | 9/1999 | Castano | 362/132 |
| 6,089,383 | A | * | 7/2000 | Heneveld | 211/14 |
| D429,936 | S | * | 8/2000 | McCormick et al. | D6/552 |
| 6,152,551 | A | * | 11/2000 | Annas | 312/224 |
| 6,520,350 | B1 | * | 2/2003 | Smith | 211/87.01 |
| 6,681,941 | B1 | * | 1/2004 | Johnson | 211/86.01 |
| 6,843,381 | B2 | * | 1/2005 | Wu | 211/85.29 |
| 2002/0130096 | A1 | * | 9/2002 | Brozak, Jr. | 211/85.1 |
| 2006/0186067 | A1 | * | 8/2006 | Rose | 211/68 |
| 2007/0114195 | A1 | * | 5/2007 | Patsalaridis | 211/85.29 |
| 2008/0053935 | A1 | * | 3/2008 | Newbouild et al. | 211/90.02 |

OTHER PUBLICATIONS

"Centennial Back Bar™," www.brunswickbilliards.com/brunswick_collection/furniture/bars_backbars/centennial_back_bar.html, 1 page, 2008.
"Back Bar," www.bar-gear.com/backbar.htm, 2 pages, 2007.

* cited by examiner

*Primary Examiner*—Jennifer E. Novosad
(74) *Attorney, Agent, or Firm*—Brinks Hofer Gilson & Lione

(57) ABSTRACT

A convertible back bar is provided. In one embodiment, a convertible back bar comprises a mirror, a body configured to support the mirror, a shelf, and a billiard ball storage tray. The shelf and the billiard ball storage tray are interchangibly attachable to upper and lower ends of the body. Other embodiments are disclosed, and each of the embodiments can be used alone or together in combination.

20 Claims, 5 Drawing Sheets

55
52
50
59
80
70
80
10
60
80
26
22
65
42
40
30
20
49
24
80

CONVERTIBLE BACK BAR

BACKGROUND

Back bars are typically used behind a bar and often contain a mirror, a stemware rack, and a shelf for storing bottles. Back bars are often decorative and may complement or match the finish and design of a bar. Back bars can be used in residential and commercial settings.

SUMMARY

The present invention is defined by the claims, and nothing in this section should be taken as a limitation on those claims.

By way of introduction, the embodiments described below provide a convertible back bar. In one embodiment, a convertible back bar is provided comprising a mirror, a body configured to support the mirror, a shelf, and a billiard ball storage tray. The shelf and the billiard ball storage tray are interchangibly attachable to upper and lower ends of the body. Other embodiments are disclosed, and each of the embodiments can be used alone or together in combination.

The embodiments will now be described with reference to the attached drawings.

DETAILED DESCRIPTION OF THE PRESENTLY PREFERRED EMBODIMENTS

Figure 1:
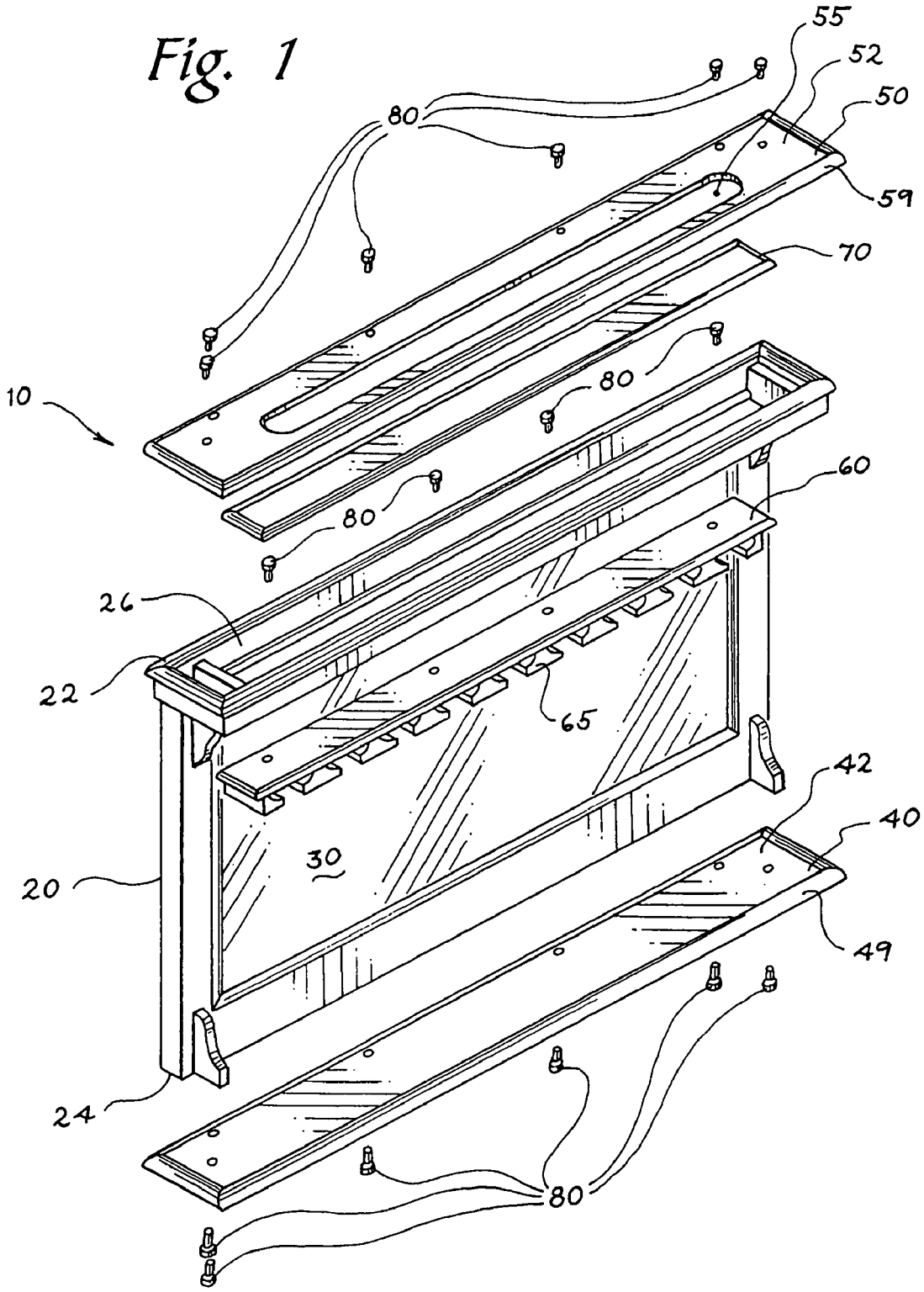
FIG. 1 is an exploded view of a convertible back bar of an embodiment.

Turning now to the drawings, FIG. 1 is an exploded view of a convertible back bar 10 of an embodiment. As shown in FIG. 1, the convertible back bar 10 of this embodiment comprises a body 20 configured to support a mirror 30, a shelf 40, a billiard ball storage tray 50, a stemware rack 60, decorative trim 70, and a plurality of attachments elements 80. In this embodiment, the shelf 40 is preferably flat and laminated, making it suitable to hold bottles. However, the shelf 40 does not have to be entirely flat (or laminated). For example, the shelf 40 can contain a raised storage compartment or other structure. Also in this embodiment, the billiard ball storage tray comprises an upper surface 52 with at least one recess 55 sized to hold at least one billiard ball. In this embodiment, the at least one recess 55 takes the form of a groove that is sized to hold a plurality of billiard balls. However, in other embodiments, the at least one recess 55 can take other forms, such as a dimple or depression in an otherwise generally flat surface. Still in other embodiments, the billiard ball storage tray 50 can comprise raised portion(s) that are used to hold billiard ball(s). In this embodiment, the lower surface of the billiard ball storage tray 50 comprises at least one billiard accessory holder (not shown in FIG. 1). Further, the stemware rack 60 comprises a plurality of protruding components 65 shaped to hold the bases of stemware.

In this embodiment, the shelf 40 and the billiard ball storage tray 50 are interchangibly attachable to upper and lower ends 22, 24 of the body 20. By being interchangible, the convertible back bar 10 easily converts between a configuration having the shelf 40 at the lower end 24 and a configuration having the billiard ball storage tray 50 at the lower end 24. Further, in this embodiment, the front surfaces 49, 59 of the shelf 40 and the billiard ball storage tray 50 that are exposed when the shelf 40 and the billiard ball storage tray 50 are attached to the upper end 22 of the body 20 look substantially similar to one another. (However, the top surfaces 42, 52 of the shelf 40 and the billiard ball storage tray 50 do not necessarily look similar, such as in this embodiment where the shelf 40 is generally flat and the billiard ball storage tray 50 comprises at least one recess 55.) As mentioned above, in some embodiments, the lower surface of the billiard ball storage tray 50 can have at least one billiard accessory holder, such as a hook, a peg, a formed recess or protraction, etc. To accommodate the billiard accessory holder, the body 20 can be formed with a recess 26 under the upper end 22 that is shaped to receive the billiard accessory holder when the billiard ball storage tray 50 is attached to the upper end 22 of the body 20.

In this embodiment, the stemware rack 60 and the decorative trim 70 are interchangibly attachable to the body 20. As such, the convertible back bar 10 easily converts between configurations with and without the stemware rack 60. In this embodiment, the recess 26 under the upper end 22 of the body 20 is shaped to store whichever one of the stemware rack 60 and decorative trim 70 is not attached to the body 20.

The plurality of attachments elements 80 are used to attach the shelf 40 and the billiard ball storage tray 50 to the upper and lower ends 22, 24, as well as to attach the stemware rack 60 or the decorative trim 70 to the body 20. In this embodiment, the plurality of attachments elements 80 take the form of screws but other suitable types of attachments elements can be used, such as, but not limited to, nails, tacks, hooks, latches, etc. Also, while all of the plurality of attachments elements 80 are shown as being the same in FIG. 1, in other embodiments, a variety of attachments elements 80 are used. Further, although not shown in FIG. 1, the convertible bar back 10 can contain a rear attachment mechanism to mount the convertible bar back 10 to a wall or other component.

Figure 2:
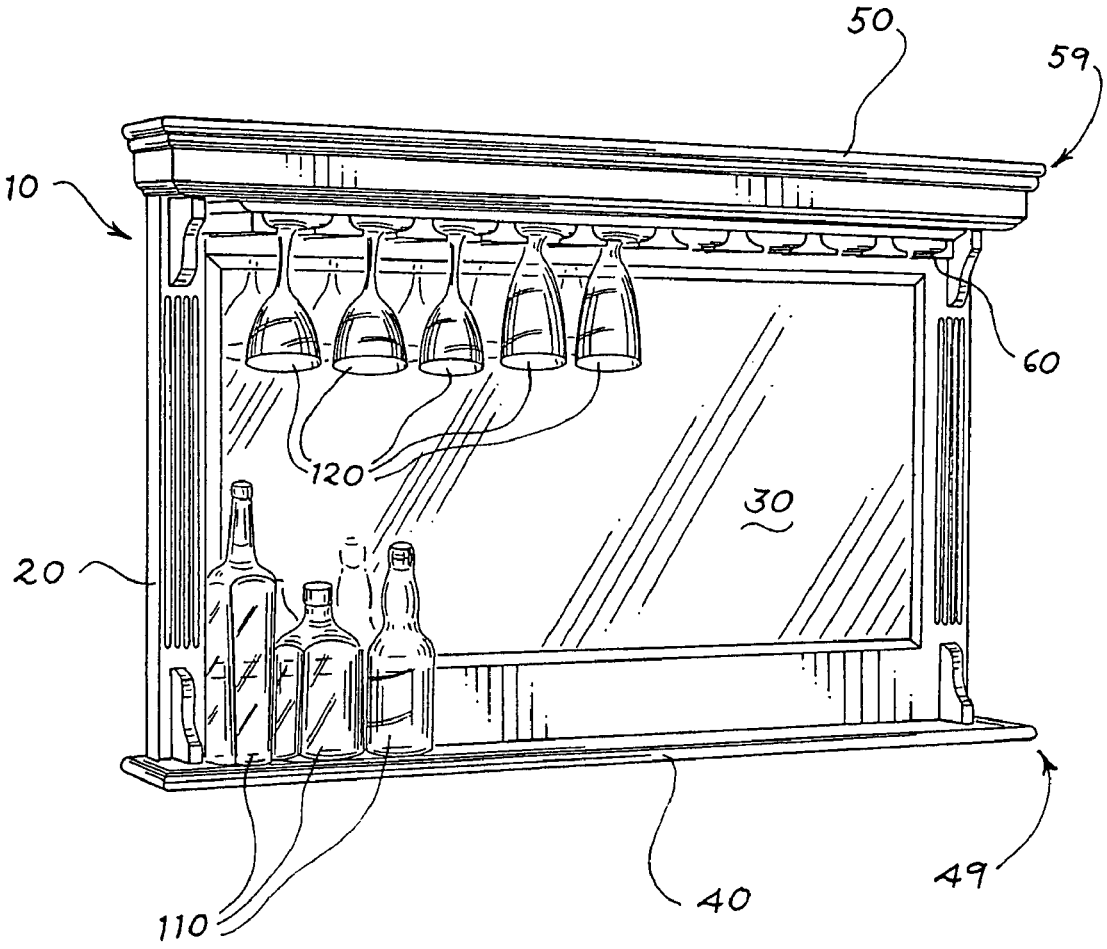
FIG. 2 is an illustration of a convertible back bar of an embodiment in which a billiard ball storage tray is attached to an upper end of the body and a shelf is attached to a lower end of the body.
Figure 3:
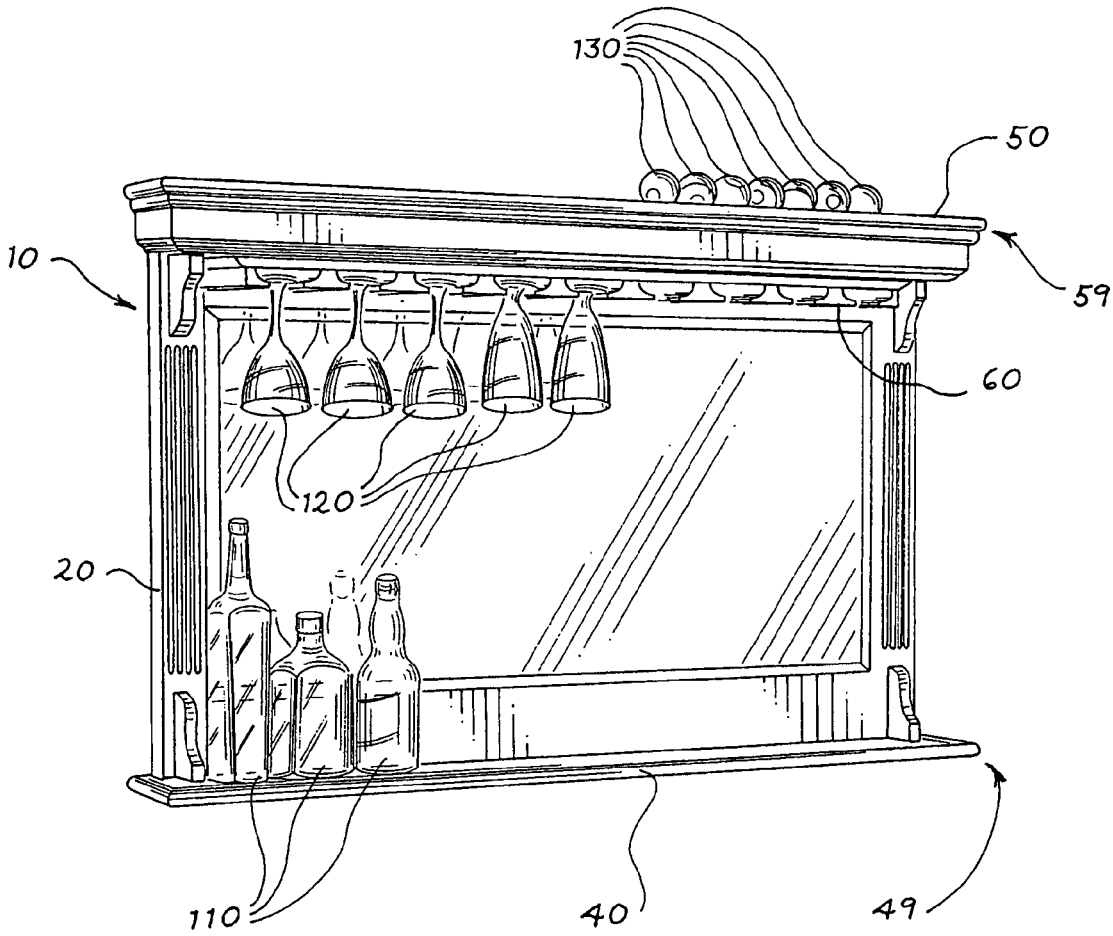
FIG. 3 is an illustration of a convertible back bar of an embodiment with billiard balls stored in the billiard ball storage tray.

Returning to the drawings FIGS. 2-5 illustrate various configurations of the convertible back bar 10. It should be noted that these are merely examples and that other configurations can be used. Turning now to FIG. 2, in this illustration, the convertible back bar 10 has the shelf 40 attached to the lower end of the body 20, the billiard ball storage tray 50 attached to the upper end of the body 20, and the stemware rack 60 attached to the body 20. This configuration is particularly useful if the convertible back bar 10 is being used behind a bar, as the shelf 40 can be used to hold bottles 110 (and/or glassware), and the stemware rack 60 can be used to hold stemmed glasses 120. Note that in this illustration, the billiard ball storage tray 50 is merely being used as a decorative top cap to the convertible back bar 10. However, as shown in FIG. 3, in other uses, the billiard ball storage tray 50 is used not merely as a top cap but also to store billiard balls 130. When the convertible back bar 10 is used is such a manner, it may be positioned behind a bar or in another location, such as on a wall near a billiard table.

Figure 4:
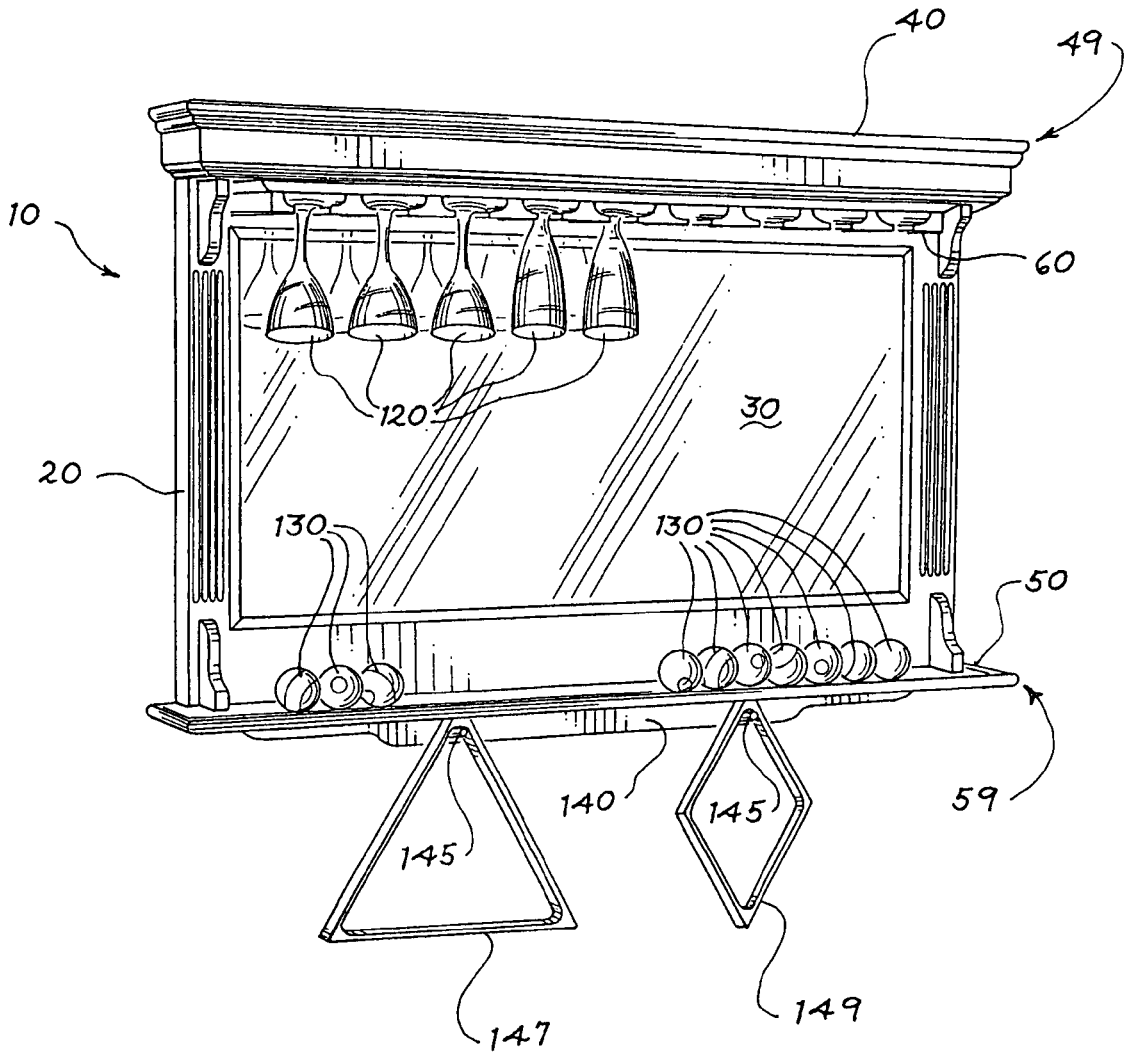
FIG. 4 is an illustration of a convertible back bar of an embodiment in which a shelf is attached to an upper end of the body and a billiard ball storage tray is attached to a lower end of the body.

In FIG. 4, the convertible back bar 10 is used in a different configuration. Specifically, the convertible back bar 10 has the billiard ball storage tray 50 attached to the lower end of the body 20, the shelf 40 attached to the upper end of the body 20 (the stemware rack 60 is still attached to the body 20 in this configuration). As shown in FIG. 4, the billiard ball storage tray 50 stores a plurality of billiard balls 130. Also, the lower surface of the billiard ball storage tray 50 comprises at least one billiard accessory holder, which, in this embodiment, takes the form of hooks 145 used to hold billiard ball racks (here, 8-ball and 9-ball racks) 147, 149. As noted above, the body 20 can be formed with a recess under its upper end to receive the billiard accessory holder 140 when the billiard ball storage tray 50 is attached to the upper end of the body 20, as in FIGS. 2 and 3. Because the stemware rack 60 is still attached to the body 20 in the configuration shown in FIG. 4, this configuration may still be useful if the convertible back bar 10 is being used behind a bar, as the stemware rack 60 can hold glasses 120. While this configuration can still be used near a billiard table as a wall mirror instead of behind a bar, if the convertible back bar 10 is being used near a billiard table and glasses storage is not needed, the stemware rack 60 can be interchanged with the decorative trim 70, as shown in FIG. 5.

Figure 5:
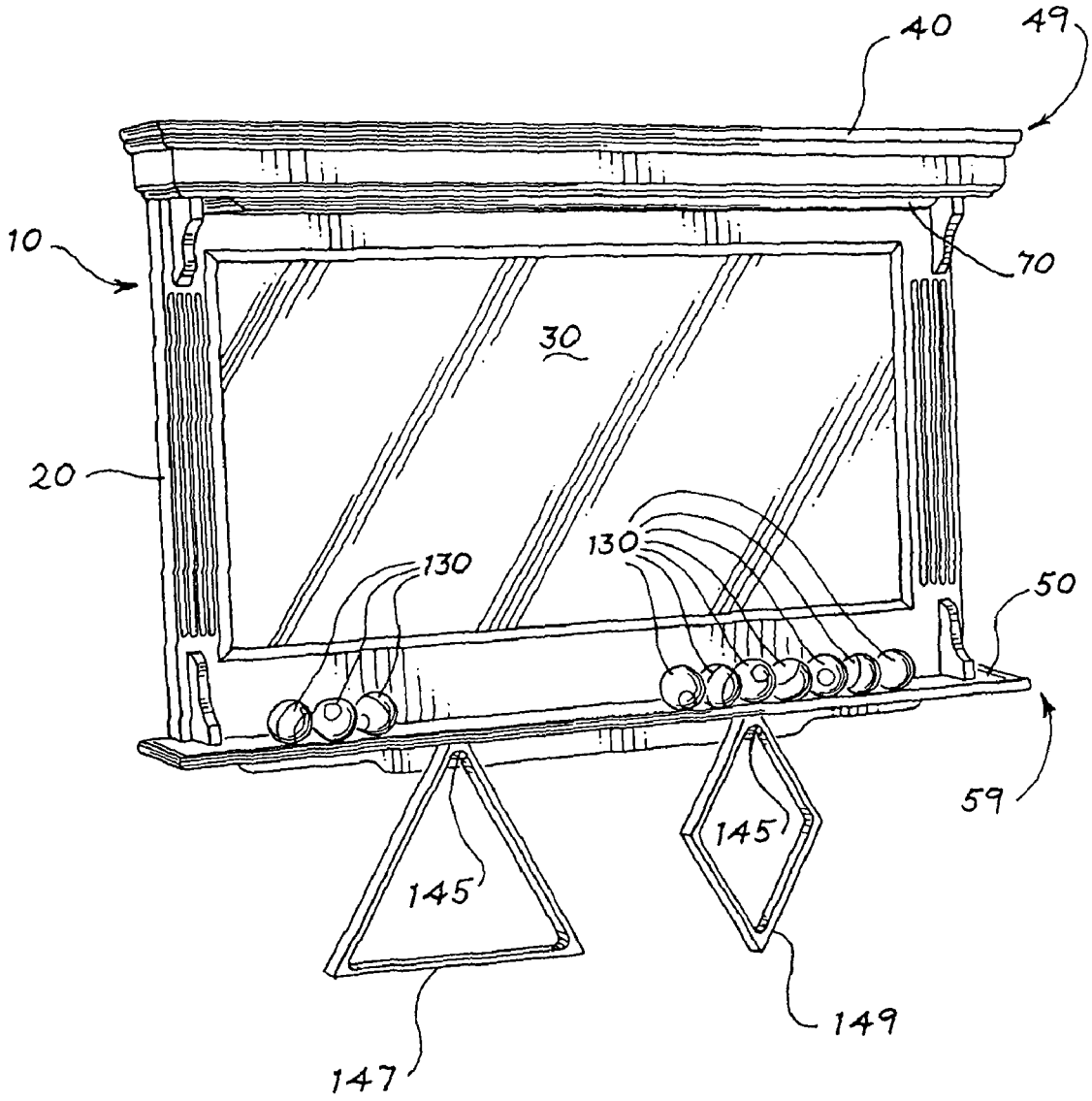
FIG. 5 is an illustration of a convertible back bar of an embodiment in which a decorative trim is used instead of a stemware rack.

It should be noted by a comparison to the configurations shown in FIGS. 4 and 5 with the configurations shown in FIGS. 2 and 3 that the front surfaces 49, 59 of the shelf 40 and the billiard ball storage tray 50 that are exposed when the shelf 40 and the billiard ball storage tray 50 are attached to the upper end of the body 20 look substantially similar to one another. This provides a flexible two-in-one design. To convert between a configuration mostly likely to be used behind a bar to a configuration most likely to be used as a wall mirror, or vice versa, a user merely needs to remove the attachments elements (e.g., using an Allen wrench or a screwdriver) and swap the shelf 40 and the billiard ball storage tray 50. In embodiments where the stemware rack 60 and decorative trim 70 are interchangible, these components could be swapped as well, with the unused component fitting in the recess at the upper end of the body 20.

Many alternatives can be used with these embodiments. For example, while the above embodiments have an interchangible stemware rack and decorative trim, in an alternate embodiment, only the shelf and billiard ball storage tray are interchangible. In such as alternate embodiment, the convertible back bar may or may not have a stemware rack. Also, while the billiard ball storage tray in the above embodiments contained a lower surface comprising at least one billiard accessory holder, in other embodiments, the billiard ball storage tray does not have a billiard accessory holder. Further, as noted above, the convertible back bar can be, but does not necessarily need to be, used behind a bar. Accordingly, the convertible back bar of these embodiments can be used behind a bar, as a wall mirror near a billiard table, or in any other desired location.

While any desired implementation can be used, in a presently preferred embodiment, the convertible back bar is dimensioned at 50" wide by 32" high by 6¼ deep. This size may provide more flexibility in fitting the convertible back bar in a variety of home settings and game rooms as compared to conventional back bars. Also, to provide an upscale look, it is presently preferred that the mirror be a beveled mirror and that the wood components be finished in chestnut, cherry, or mahogany.

It is intended that the foregoing detailed description be understood as an illustration of selected forms that the invention can take and not as a definition of the invention. It is only the following claims, including all equivalents, that are intended to define the scope of this invention. Finally, it should be noted that any aspect of any of the preferred embodiments described herein can be used alone or in combination with one another.

What is claimed is:

1. A convertible back bar comprising:

a mirror;

a body configured to support the mirror, the body having an upper end above the mirror and a lower end below the mirror;

a shelf having an upper surface, a lower surface, and a front surface; and a billiard ball storage tray having an upper surface, a lower surface, and a front surface;

wherein the shelf and the billiard ball storage tray are interchangibly attachable to the upper and lower ends of the body, such that (i) when the shelf is attached to the upper end of the body, the lower surface of the shelf is attached to the upper end of the body, and when the shelf is attached to the lower end of the body, the upper surface of the shelf is attached to the lower end of the body, and (ii) when the billiard ball storage tray is attached to the upper end of the body, the lower surface of the billiard ball storage tray is attached to the upper end of the body and when the billiard ball storage tray is attached to the lower end of the body, the upper surface of the billiard ball storage tray is attached to the lower end of the body.

2. The convertible back bar of claim 1, wherein the front surfaces of the shelf and the billiard ball storage tray that are exposed when the shelf and the billiard ball storage tray are attached to the upper end of the body look substantially similar to one another.

3. The convertible back bar of claim 1, wherein the upper surface of the billiard ball storage tray comprises at least one recess sized to hold at least one billiard ball, and wherein the lower surface of the billiard ball storage tray comprises at least one billiard accessory holder.

4. The convertible back bar of claim 3, wherein the at least one recess comprises a groove sized to hold a plurality of billiard balls.

5. The convertible back bar of claim 3, wherein the upper end of the body comprises a recess that is shaped to receive the at least one billiard accessory holder when the billiard ball storage tray is attached to the upper end of the body.

6. The convertible back bar of claim 3, wherein the at least one billiard accessory holder comprises at least one hook.

7. The convertible back bar of claim 1 further comprising a stemware rack attachable to the body.

8. The convertible back bar of claim 1 further comprising:

a stemware rack; and a decorative trim;

wherein the stemware rack and the decorative trim are interchangibly attachable to the body.

9. The convertible back bar of claim 8, wherein the upper end of the body comprises a recess that is shaped to store one of the stemware rack and the decorative trim when said one of the stemware rack and the decorative trim is not attached to the body.

10. The convertible back bar of claim 1, wherein the shelf is flat.

11. The convertible back bar of claim 1 further comprising a plurality of attachments elements operative to attach the shelf and the billiard ball storage tray to the upper and lower ends of the body.

12. The convertible back bar of claim 11, wherein the plurality of attachments elements comprise screws.

13. A convertible back bar comprising:

a mirror;

a body configured to support the mirror, the body having an upper end above the mirror and a lower end below the mirror;

a shelf having an upper surface, a lower surface, and a front surface;

a billiard ball storage tray having an upper surface, a lower surface, and a front surface, wherein the upper surface comprises at least one recess sized to hold at least one billiard ball;

a stemware rack; and a decorative trim;

wherein the shelf and the billiard ball storage tray are interchangibly attachable to the upper and lower ends of the body such that (i) when the shelf is attached to the upper end of the body, the lower surface of the shelf is attached to the upper end of the body, and when the shelf is attached to the lower end of the body, the upper surface of the shelf is attached to the lower end of the body, and (ii) when the billiard ball storage tray is attached to the upper end of the body, the lower surface of the billiard ball storage tray is attached to the upper end of the body and when the billiard ball storage tray is attached to the lower end of the body, the upper surface of the billiard ball storage tray is attached to the lower end of the body, and wherein the stemware rack and the decorative trim are interchangibly attachable to the body.

14. The convertible back bar of claim 13, wherein the front surfaces of the shelf and the billiard ball storage tray that are exposed when the shelf and the billiard ball storage tray are attached to the upper end of the body look substantially similar to one another.

15. The convertible back bar of claim 13, wherein the at least one recess comprises a groove sized to hold a plurality of billiard balls.

16. The convertible back bar of claim 13, wherein the lower surface of the billiard ball storage tray comprises least one billiard accessory holder, and wherein the upper end of the body comprises a recess that is shaped to receive the at least one billiard accessory holder when the billiard ball storage tray is attached to the upper end of the body.

17. The convertible back bar of claim 16, wherein the at least one billiard accessory holder comprises at least one hook.

18. The convertible back bar of claim 13, wherein the upper end of the body comprises a recess that is shaped to store one of the stemware rack and the decorative trim when said one of the stemware rack and the decorative trim is not attached to the body.

19. The convertible back bar of claim 13, wherein the shelf is flat.

20. The convertible back bar of claim 13 further comprising a plurality of attachments elements operative to attach the shelf and the billiard ball storage tray to the upper and lower ends of the body.

* * * * *

UNITED STATES PATENT AND TRADEMARK OFFICE

CERTIFICATE OF CORRECTION

PATENT NO. : 7,896,176 B2
APPLICATION NO. : 12/009617
DATED : March 1, 2011
INVENTOR(S) : William R. McCormick It is certified that error appears in the above-identified patent and that said Letters Patent is hereby corrected as shown below:

In the Claims

Column 6, claim 16, line 10, after "ball storage tray comprises" insert --at--.

Signed and Sealed this
Thirty-first Day of May, 2011

David J. Kappos

David J. Kappos
*Director of the United States Patent and Trademark Office*